United States Patent [19]

Leibhard et al.

[11] 4,358,030

[45] Nov. 9, 1982

[54] DEVICE FOR THE MELTING AND MEASURED DISCHARGE OF THERMOPLASTIC ADHESIVE

[75] Inventors: Erich Leibhard, Munich; Franz Popp, Puchheim, both of Fed. Rep. of Germany

[73] Assignee: Hilti Aktiengesellschaft, Fürstentum, Liechtenstein

[21] Appl. No.: 143,847

[22] Filed: Apr. 25, 1980

[30] Foreign Application Priority Data

Apr. 30, 1979 [DE] Fed. Rep. of Germany ..... 2917474

[51] Int. Cl.[3] ..... B67D 5/62

[52] U.S. Cl. ..... 222/146 H; 219/230; 308/3.5

[58] Field of Search ..... 222/146 H, 146 HE; 219/230; 308/3.5

[56] References Cited

U.S. PATENT DOCUMENTS

| | | | |
|---|---|---|---|
| 341,973 | 5/1886 | Watson | 308/3.5 |
| 3,298,572 | 1/1967 | Newton . | |
| 3,330,605 | 7/1967 | Jasmand | 308/3.5 |
| 3,570,037 | 3/1971 | Rood | 308/3.5 X |
| 4,150,770 | 4/1979 | Weiland et al. | 222/146 HE |

*Primary Examiner*—Joseph J. Rolla
*Assistant Examiner*—Frederick R. Handren
*Attorney, Agent, or Firm*—Toren, McGeady & Stanger

[57] ABSTRACT

In a device for the melting and measured discharge of a thermoplastic adhesive, a sealing sleeve conveys the solid thermoplastic adhesive into the inlet end of a melting chamber. The sealing sleeve is formed of a temperature resistant, poor heat conductive material with good sliding properties, such as polytetrafluoroethylene. Further, the sealing sleeve is provided with slots extending in the axial direction of the sleeve from the end more remote from the melting chamber toward the melting chamber.

18 Claims, 3 Drawing Figures

DEVICE FOR THE MELTING AND MEASURED DISCHARGE OF THERMOPLASTIC ADHESIVE

SUMMARY OF THE INVENTION

The present invention is directed to a device for the melting and measured discharge of thermoplastic adhesive and, more particularly, to a sealing sleeve at the inlet end of a melting chamber in the device.

Thermoplastic adhesives are being used to an increasing extent for both industrial and commercial purposes, because of their advantages, such as short curing time, the fact that the output can be adequately measured, and such adhesives are free of solvents which could, during processing, generate explosive vapors or vapors harmful to health. Devices used for processing such adhesives have undergone continued development and have been improved continuously.

A significant problem experienced in the use of such thermoplastic materials involves sealing of the inlet into the melting chamber. To prevent the liquified adhesive material within the melting chamber from flowing out of its rearward end, it has been conventional to provide a sealing sleeve at the inlet into the melting chamber. The sealing sleeve should be adjustable to the varying transverse cross section of the body of thermoplastic adhesive admitted into the melting chamber. In the past, it has been usual to utilize elastic materials for the sealing sleeve, such as rubber-like silicon elastomers. When such sealing sleeves are new they afford a good sealing effect. Since the sealing sleeve leads into the melting chamber which is exposed to a relatively high temperature, the sealing sleeve is also heated to a high temperature during operation. Such heating, however, is detrimental to the elastic properties of the sealing sleeve. Accordingly, the sealing sleeve tends to become hardened and brittle after a short period of operation so that it can no longer effectively fulfill its intended use. Another disadvantage to the use of rubber-like materials for the sealing sleeve is that the thermoplastic adhesive tends to adhere to the sleeve material and the movement of the body of thermoplastic material into the melting chamber is impaired.

To avoid the disadvantages experienced in the past, different materials have been used for the sealing sleeve. One particularly suitable material has been polytetrafluoroethylene (PTFE) known more familiarly by its tradename "TEFLON". Such material has a low heat conductive character and good sliding properties or, in other words, it has a low tendency to adhere to the solid thermoplastic material. A disadvantage of such material, however, involves the fact that its elasticity is too low.

Therefore, it is the primary object of the present invention to provide a sealing sleeve formed of a material which is heat-resistant yet is sufficiently elastic.

In accordance with the present invention, the sealing sleeve is formed of a temperature-resistant, poor heat-conducting material having good sliding properties. Further, the sleeve is provided with slots which extend over a portion of the axially extending length of the sleeve with the slots extending from the inlet end of the sleeve, that is, the end more remote from the inlet end, into the melting chamber.

Because of the axially extending slots provided in the sealing sleeve in accordance with the present invention, at least the inlet portion of the sleeve is divided into individual, resilient lugs. These individual lugs which are resilient independently of one another, are capable of adjusting to the cross-sectional shape of the solid thermoplastic material entering the inlet end of the melting chamber. It is not unusual when the cross-sectional shape of the solid thermoplastic material is not round. The above-mentioned "TEFLON" (PTFE) appears to be especially suitable as the material used for the sealing sleeve. Other materials with an appropriate coating can also be used. The resilience of the individual lugs can be optimized by the thickness of the material of the sealing sleeve and also by the number and length of the individual longitudinal slots formed between the lugs.

While certain materials are deformable, they are not sufficiently elastic. Therefore, in sealing sleeves formed of such material, it is advantageous if the individual lugs are pressed inwardly against the surface of the body of thermoplastic adhesive. This inward pressing action can be provided by a spring element encircling and pressing the sealing sleeve inwardly against the thermoplastic material. In one embodiment, the spring element can be formed as an annular spring, that is, a tension spring laterally encircling the sealing sleeve. One advantage of such an annular spring is its heat resistance. Another feature of such an arrangement is that the assembly and, if necessary, the disassembly of such a spring ring is particularly simple. It is also possible to use rubber rings, such as O-rings, as the spring elements with such rings being placed in an appropriate groove in the outer periphery of the sealing sleeve. Further, it is also possible to use compression springs located on the periphery of the sealing sleeve for pressing the individual lugs inwardly.

By forming axially extending slots in the rearward portion of the sealing sleeves, openings are formed through which the liquefied thermoplastic adhesive can flow in the rearward direction. Accordingly, to prevent any rearward flow of the thermoplastic material and, at the same time, to assure the radial resilience of the individual lugs, it is advantageous if the spring element is in the form of a sheath-like member of an elastic rubber material. Since the sheath-like member does not contact the heated thermoplastic adhesive or only comes into contact with it to an insignificant extent, silicon rubber has proved to be useful in forming such sheath-like members. Silicon rubber has excellent elastic properties. In addition to silicon rubber, however, other types of rubber or elastic plastics materials can also be utilized.

In still another embodiment, the spring element can be formed as an axially slotted bushing with the slots arranged in angularly offset relation to the slots in the sealing sleeve. Such a bushing can be formed of the same material as the sealing sleeve itself. Accordingly, contact of the two members does not create any problems. If necessary, for reasons of service life, the slotted bushing can be formed of glass fiber-reinforced thermoplastics material or of metal. The sealing sleeve separating the melting chamber and the spring element, prevents any excessive heating if the bushing is formed of metal. By angularly offsetting the axially extending slots in the sealing sleeve and the enclosing bushing, the slots do not open into one another, accordingly, the liquefied or melted thermoplastic adhesive cannot flow rearwardly out through the slots. Since the axially extending slots are covered, the slots can be made relatively wide so that no expensive special tools or methods are needed for forming them.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figures 1, 2, 3:
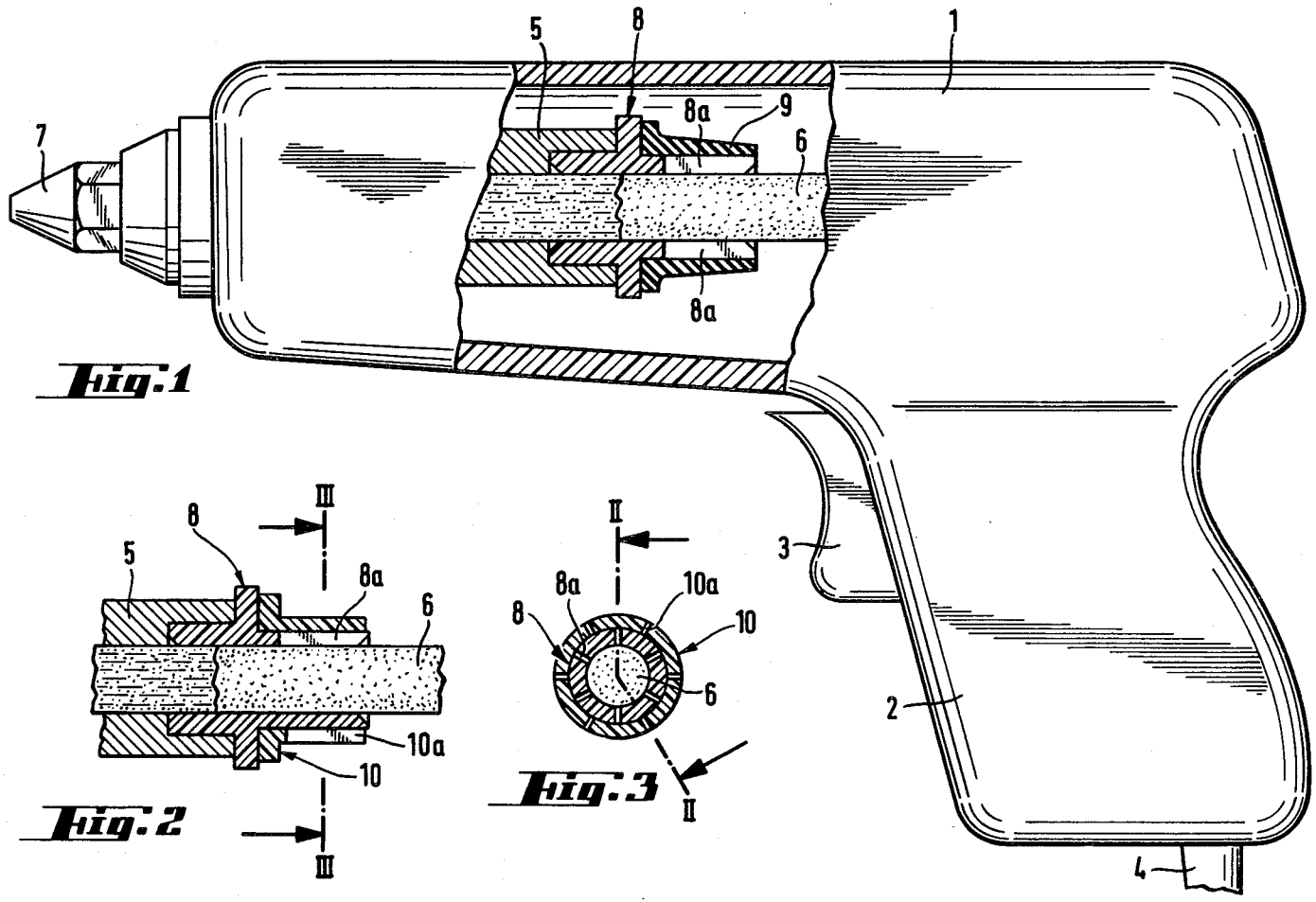
FIG. 1 is a side view, partly in section, of a device embodying the present invention.
FIG. 2 is a partial sectional view, taken along the line II—II of FIG. 3, illustrating another embodiment of the design incorporating the present invention.
FIG. 3 is a cross-sectional view taken along the line III—III of the embodiment shown in FIG. 2.

The device for the melting and measured discharge of thermoplastic adhesive is shown in FIG. 1 and consists of a hand-gun shaped housing 1 including a dependently arranged handle 2. A trigger 3 is mounted in the handle and an electrical supply line 4 is connected into the bottom of the handle. A melting chamber 5 is located in the forward part of the housing 1, that is the left-hand part as viewed in FIG. 1 and the part of the chamber shown is illustrated in section. When the trigger 3 is squeezed, a body of solid thermoplastic adhesive 6 is advanced into the heating chamber, that is into the right-hand end of the melting chamber as viewed in FIG. 1 by means of a known transport mechanism, not shown. Within the melting chamber 5, the body of solid thermoplastic adhesive 6 is melted and converted into the liquid state. At its rear end, the melting chamber 5 is closed by the body of thermoplastic adhesive which is in the solid state.

By advancing the body of adhesive 6 into the inlet end of the melting chamber 5, a portion of the adhesive previously introduced into the chamber and in the liquid state is displaced from the chamber and is discharged from its forward or left-hand end through a nozzle 7 in the housing 1. At the inlet end of the melting chamber 5, a sealing sleeve 8 is positioned for preventing leakage losses out of the inlet end in the direction opposite to the normal flow of the thermoplastic adhesive through the melting chamber 5. The sealing sleeve 8 is formed of a temperature-resistant, poor heat-conducting material with good sliding properties. Good sliding properties means that the solid thermoplastic adhesive moves relative to the sealing sleeve without sticking to it. These characteristics of the sealing sleeve material can be provided, for example, by polytetrafluoroethylene (PTFE), commercially available under the name TEFLON. Such a material, however, is not sufficiently elastic for affording a good sealing effect, accordingly, the sealing sleeve 8 is provided with axially extending slots 8*a* extending from the rear or right-hand end of the sleeve toward its forward or left-hand end. Due to these axially extending slots 8*a*, the axially extending rear portion of the sealing sleeve 8 is divided into a number of individual, axially extending, resilient lugs or fingers. These axially extending slots 8*a*, however, give rise to the possibility that the liquid or melted thermoplastic adhesive within the melting chamber flows out through the sealing sleeve. To prevent such an occurrence, in accordance with the present invention, an axially extending sheath-like member 9 formed of a rubber-like material is slipped over the sealing sleeve 8. Accordingly, the sheath-like member 9 affords a closure for the radially outer sides of the axially extending slots 8*a* and, in addition, affords a clamping force biasing the individual lugs between the slots in the radially inward direction. Since the sheath-like member 9 does not directly contact the body of thermoplastic adhesive 6 or the melting chamber 5, it can be made of less heat-resistant materials, such as silicon rubber which has a high elasticity. Because the sheath-like member is slid directly over the sealing sleeve 8, replacement of the sheath-like member is particularly simple.

In FIG. 2 another embodiment of the device, in accordance with the present invention, is illustrated. The melting chamber 5 and the sealing sleeve 8 are formed in the same manner as in the embodiment of FIG. 1. Sealing sleeve 8 has axially extending slots 8*a* extending from the inlet or right-hand end of the sleeve toward the outlet or left-hand end into the melting chamber. Instead of a sheath-like member 9, a bushing 10 is slipped over the sealing sleeve 8 so that it laterally encircles the rear portion of the sleeve. Bushing 10 has a number of axially extending slots 10*a* which extend from its rearward end for approximately the length of the slots 8*a* in the sealing sleeve. The slots 10*a* are offset in the circumferential direction relative to the axially extending slots 8*a* in the sealing sleeve 8. As a result, the resilient lugs or fingers located between the axially extending slots 8*a* and 10*a* cover the slots in the adjacent member. As a result, the thermoplastic adhesive 6 which has become melted in the melting chamber cannot flow out of the slots 8*a* in the sealing sleeve. The bushing 10 can be made of the same material as the sealing sleeve 8. Use of the same material for both parts prevents any problems caused by a reaction at the contacting surfaces of the two parts. When the lugs formed between the slots 10*a* have a sufficient initial stress, the bushing 10 is automatically held on the sealing sleeve 8.

In the section through the sealing sleeve 8 and the bushing 10 shown in FIG. 3, it can be seen that the slots 10*a* of the bushing 10 are offset angularly relative to the axially extending slots 8*a* in the sealing sleeve 8. This offset relation prevents the adhesive from flowing out through the slots 8*a*.

While specific embodiments of the invention have been shown and described in detail to illustrate the application of the inventive principles, it will be understood that the invention may be embodied otherwise without departing from such principles.

What is claimed is:

1. Device for the melting and measured discharge of a thermoplastic adhesive comprising walls forming a melting chamber having an inlet end through which a body of solid thermoplastic adhesive of variable cross sectional size and shape is introduced into said melting chamber and an outlet end spaced from said inlet end for discharging melted thermoplastic material from said melting chamber, an axially extending sealing sleeve positioned at said inlet end of said melting chamber so that the solid thermoplastic material can be passed through said sealing sleeve and into said inlet end of said melting chamber, said sealing sleeve arranged to be in surface contact with the outside surface of the body of solid thermoplastic adhesive for preventing melted adhesive from flowing rearwardly through said sleeve out of said melting chamber, wherein the improvement comprises that said sealing sleeve is formed of a temperature-resistant poor heat-conductive material having good sliding properties, said sealing sleeve having a first end located at the inlet end of said melting chamber and a second end spaced axially outwardly from said melting chamber in the direction away from said melting chamber, and said sealing sleeve having slots dividing said second end of said sealing sleeve into independently movable resilient lugs, said slots extending in the axial direction of said sealing sleeve through said second end toward said first end with said slots spaced apart around the circumference of said sealing sleeve.

2. Device, as set forth in claim 1, including a spring element laterally enclosing said sealing sleeve with said spring element applying an inwardly directed force to said sealing sleeve.

3. Device, for the melting and measured discharge of a thermoplastic adhesive comprising walls forming a melting chamber having an inlet end through which solid thermoplastic adhesive is introduced into said melting chamber and an outlet end spaced from said inlet end for discharging melted thermoplastic material from said melting chamber, an axially extending sealing sleeve positioned at said inlet end of said melting chamber so that the solid thermoplastic material passes through said sealing sleeve and into said inlet end of said melting chamber, wherein the improvement comprises that said sealing sleeve is formed of a temperature-resistant poor heat-conductive material having good sliding properties, said sealing sleeve having a first end located at the inlet end of said melting chamber and a second end spaced axially outwardly from said melting chamber in the direction away from said melting chamber, and said sealing sleeve having slots extending in the axial direction thereof from said second end toward said first end with said slots spaced apart around the circumference of said sealing sleeve, a spring element laterally enclosing said sealing sleeve with said spring element applying an inwardly directed force to said sealing sleeve, and said spring element extends in the axial direction of said sealing sleeve for at least the length of said slots within said sealing sleeve.

4. Device for the melting and measured discharge of a thermoplastic adhesive comprising walls forming a melting chamber having an inlet end through which solid thermoplastic adhesive is introduced into said melting chamber and an outlet end spaced from said inlet end for discharging melted thermoplastic material from said melting chamber, an axially extending sealing sleeve positioned at said inlet end of said melting chamber so that the solid thermoplastic material passes through said sealing sleeve and into said inlet end of said melting chamber wherein the improvement comprises that said sealing sleeve is formed of a temperature-resistant poor heat-conductive material having good sliding properties, said sealing sleeve having a first end located at the inlet end of said melting chamber and a second end spaced axially outwardly from said melting chamber in the direction away from said melting chamber, and said sealing sleeve having slots extending in the axial direction thereof from said second end toward said first end with said slots spaced apart around the circumference of said sealing sleeve, a spring element laterally enclosing said sealing sleeve with said spring element applying an inwardly directed force to said sealing sleeve, and said spring element comprises a sheath-like member formed of an elastic rubber material.

5. Device, as set forth in claim 2, wherein said spring element comprises an axially extending bushing having a first end closer to said melting chamber and a second end more remote from said melting chamber, said bushing having slots extending in the axial direction of said sleeve from the second end thereof toward said first end.

6. Device, as set forth in claim 5, wherein said slots in said bushing being co-extensive with said slots in said sealing sleeve and being angularly offset from said slots in said sealing sleeve so that the body of said bushing between said slots therein forms a closure over said slots in said sealing sleeve.

7. Device, as set forth in claim 4, wherein said sheath-like member is formed of a highly elastic silicon rubber.

8. Device, as set forth in claim 5, wherein said sealing sleeve and said bushing being formed of the same material.

9. Device, as set forth in claim 8, wherein said sealing sleeve and said bushing being formed of polytetrafluoroethylene.

10. Device for the melting and measured discharge of a thermoplastic adhesive comprising walls forming a melting chamber having an inlet end through which a body of solid thermoplastic adhesive of variable cross sectional size and shape is introduced into said melting chamber and an outlet end spaced from said inlet end for discharging melted thermoplastic material from said melting chamber, an axially extending sealing sleeve positioned at said inlet end of said melting chamber so that the solid thermoplastic material can be passed through said sealing sleeve and into said inlet end of said melting chamber, said sealing sleeve arranged to be in surface contact with the outside surface of the body of solid thermoplastic adhesive for preventing melted adhesive from flowing rearwardly through said sealing sleeve out of the inlet end of said melting chamber, wherein the improvement comprises that said sealing sleeve is formed of a temperature-resistant poor heat-conductive material having good sliding properties, said sealing sleeve having a first end located at the inlet end of said melting chamber and a second end spaced axially outwardly from said melting chamber in the direction away from said melting chamber, said sealing sleeve having slots dividing said second end of said sealing sleeve into independently movable resilient lugs, said slots extending in the axial direction of said sealing sleeve through said second end toward said first end with said slots spaced apart around the circumference of said sealing sleeve, and means laterally enclosing the axially extending portion of said sealing sleeve having slots therein for preventing the flow of the melted adhesive outwardly through said slots.

11. Device, as set forth in claim 10, wherein said means include a spring element laterally enclosing said sealing sleeve with said spring element applying an inwardly directed force to said sealing sleeve.

12. Device, as set forth in claim 11, wherein said spring element extends in the axial direction of said sealing sleeve for at least the length of said slots within said sealing sleeve.

13. Device, as set forth in claim 11, wherein said spring element comprises a sheath-like member formed of an elastic rubber material.

14. Device, as set forth in claim 13, wherein said sheath-like member is formed of a highly elastic silicon rubber.

15. Device, as set forth in claim 11, wherein said spring element comprises an axially extending bushing having a first end closer to said melting chamber and a second end more remote from said melting chamber, said bushing having slots extending in the axial direction of said sleeve from the second end toward said first end.

16. Device, as set forth in claim 15, wherein said slots in said bushing are coextensive with said slots in said sealing sleeve and are angularly offset from said slots and said sealing sleeve so that the body of said bushing between said slots therein forms a closure over said slots in said sealing sleeve.

17. Device, as set forth in claim 15, wherein said sealing sleeve and said bushing are formed of the same material.

18. Device, as set forth in claim 17, wherein said sealing sleeve and said bushing are formed of polytetrafluoroethylene.

* * * * *